United States Patent [19]

Kojima

[11] Patent Number: 4,967,713

[45] Date of Patent: Nov. 6, 1990

[54] AIR-FUEL RATIO FEEDBACK CONTROL SYSTEM FOR INTERNAL COMBUSTION ENGINE

[75] Inventor: Kazuo Kojima, Yokohama, Japan

[73] Assignee: Nissan Motor Company Limited, Yokohama, Japan

[21] Appl. No.: 437,292

[22] Filed: Nov. 16, 1989

Related U.S. Application Data

[63] Continuation of Ser. No. 197,334, May 23, 1988, abandoned.

[30] Foreign Application Priority Data

May 27, 1987 [JP] Japan ..... 62-78722[U]

[51] Int. Cl.[5] ..... F02M 51/00

[52] U.S. Cl. ..... 123/489; 123/520; 123/518

[58] Field of Search ..... 123/489, 520, 440, 461, 123/178

[56] References Cited

U.S. PATENT DOCUMENTS

| | | | |
|---|---|---|---|
| 4,641,623 | 2/1987 | Hamburg | 123/520 |
| 4,730,590 | 3/1988 | Sogawa | 123/489 |
| 4,741,317 | 5/1988 | Yost | 123/520 |
| 4,741,318 | 5/1988 | Kortge et al. | 123/520 |
| 4,748,956 | 6/1988 | Iwaki | 123/489 |
| 4,748,957 | 6/1988 | Menard et al. | 123/489 |
| 4,748,959 | 6/1988 | Cook et al. | 123/489 |
| 4,759,332 | 7/1988 | Morozumi | 123/489 |
| 4,763,629 | 8/1988 | Okazaki et al. | 123/489 |
| 4,763,634 | 8/1988 | Morozumi | 123/520 |
| 4,771,753 | 9/1988 | Ohishi | 123/489 |

FOREIGN PATENT DOCUMENTS

| | | | |
|---|---|---|---|
| 54-25973 | 8/1979 | Japan | 123/489 |

*Primary Examiner*—Raymond A. Nelli

*Attorney, Agent, or Firm*—Foley & Lardner, Schwartz, Jeffery, Schwaab, Mack, Blumenthal & Evans

[57] ABSTRACT

An air-fuel ratio feedback control system for an automotive internal combustion engine equipped with an evaporative emission control device having an activated charcoal cansiter for absorbing fuel vapor from a fuel tank. The air-fuel ratio feedback control system is operated as follows: The air-fuel ratio of air-fuel mixture to be inducted into the engine is detected in accordance with a component of exhaust gas discharged from the engine. An air-fuel ratio feedback correction coefficient is set in accordance with the air-fuel ratio in such a manner as to be modified by a feedback control constant in response to the state of the air-fuel ratio relative to stoichiomeric value. The amount of fuel to be supplied to the engine is corrected with the air-fuel ratio feedback correction coefficient. Additionally, the feedback control constant is enlarged for a predetermined time when the evaporative emission control device is so operated that the fuel vapor stored in the activated charcoal canister is sucked into the engine, thereby improving follow-up ability of air-fuel ratio feedback control thus to improve exhaust emission control and driveability of the engine.

19 Claims, 3 Drawing Sheets

AIR-FUEL RATIO FEEDBACK CONTROL SYSTEM FOR INTERNAL COMBUSTION ENGINE

This application is a continuation of application Ser. No. 197,334, filed May 23, 1988, now abandoned.

BACKGROUND OF THE INVENTION

1. Field of the Invention

This invention relates in general to improvements in an air-fuel ratio feedback control system for an internal combustion engine provided with an evaporative emission control device, and more particularly to such an air-fuel ratio feedback control system provided with means for preventing temporary air-fuel ratio fluctuation of air-fuel mixture to be inducted into the engine, due to purge of fuel vapor absorbed in the evaporative emission control device.

2. Description of the Prior Art

An Electronically controlled fuel injection system for an automotive internal combustion enigne includes a fuel injector valve which is such arranged as to open in response to drive pulse signal produced in timed relation to engine speed of the engine, so that fuel at a predetermined pressure is injected during a time period of opening of the fuel injector valve. Accordingly, the amount (fuel injection amount) of fuel to be injected from the fuel injector valve is controlled in accordance with the pulse width of the drive pulse signal. Assuming that Ti is the pulse signal corresponding to the fuel injection amount, Ti is calculated to obtain the stoichiometric air-fuel ratio as a tagrget air-fuel ratio, by the following equation:

$$Ti = Tp \cdot COEF \cdot \alpha + Ts$$

where Tp is fundamental pulse width corresponding to fundamental fuel injection amount and referred to as fundamental fuel injection amount. The fundamental fuel injection amount is calculated by an equation of $Tp = K \cdot Q/N$ where K is a constant, Q is the amount of intake air inducted to an engine; N is the engine speed of engine. COEF is various correction coefficients such as engine coolant temperature correction and acceleration correction coefficients;$\alpha$ is an air-fuel ratio feedback correction coefficient for feedback control of air-fuel ratio discussed after; and Ts is a voltage correction amount for correcting the fuel injection amount variation in the fuel injector valve, due to fluctuation in voltage of a battery.

The air-fuel ratio feedback control is carried out such that actual air-fuel ratio of the air-fuel mixture is detected by an oxygen ($O_2$) sensor thereby to judge as to whether the air-fuel ratio is rich or lean relative to stoichiometric air-fuel ratio. In this regard, the above-mentioned feedback correction coefficient $\alpha$ is determined and controllably varied in order to converge the air-fuel ratio into the stoichiometric value. Here, the value of the air-fuel ratio correction coefficient $\alpha$ is varied by a proportional-plus-integral control (PI control) thereby to accomplish a stable control thereof. More specifically, in this control, the output voltage of the oxygen sensor is compared with a slice level voltage. In case the output voltage of the oxygen sensor is higher or lower than the slice level, the air-fuel ratio is prevented from being suddenly made richer or leaner. That is to say, when the air-fuel ratio is rich ( or lean) relative to the stoichiometric air-fuel ratio, the air-fuel ratio feedback correction coefficient $\alpha$ is first reduced (or increased) by the amount of a predetermined proportion constant P and then gradually reduced (increased) by the amount of a predetermined integration constant I, thus appoaching the air-fuel ratio to the stoichiometric value. Such a control is disclosed, for example, in Japanese Patent Publication No. 54-25973.

Here, feedback control constants such as the above-mentioned proportion and integration constants P and I are better to be larger to obtain high follow-up ability for the air-fuel ratio against variation of the intake air amount; however, they are better to be smaller to minimize the width of air-fuel ratio variation during control. Even in this, regard, control or matching is accomplished by employing the latter prior to the former.

Now, most automotive vehicles are equipped with an evaporative emission control device in which fuel vapor generated in a fuel tank is introduced into an activated charcoal canister to be absorbed in activated charcoal, and the thus absorbed fuel vapor is purged with fresh air introduced to the activated charcoal canister under a predetermined engine operating condition. The mixture of the fuel vapor and the fresh air are thereafter sucked through an intake manifold into the engine so that the fuel vapor is combusted in combustion chambers of the engine.

Difficulties have been encountered in such an engine equipped with the evaporative emission control device. When the fuel vapor absorbed in the activated charcoal canister is purged and sucked into the engine, the air-fuel ratio of the air-fuel mixture to be supplied to the engine unavoidably temporarily shifts from the target value, so that the air-fuel ratio becomes far from the target value for a while owing to delay of feedback control. This deteriorates exhaust emission control and driveability of the engine.

SUMMARY OF THE INVENTION

The first aspect of the present invention resides in an air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition. The air-fuel ratio feedback control system is comprised of first means for detecting air-fuel ratio of air-fuel mixture to be inducted into the engine in accordance with a component of exhaust gas discharged from the engine. Second means is provided to set air-fuel ratio feedback correction coefficient in accordance with the air-fuel ratio. The second means includes means for modifying the air-fuel ratio feedback correction coefficient by a feedback control constant in response to the state of the air-fuel ratio relative to a stoichiometric value. Third means is provided to supply fuel to the engine. Fourth means is provided to correct the amount of the fuel supplied from the third means with the air-fuel ratio feedback correction coefficient. Additionally, fifth means is provided to enlarge the feedback control constant for a predetermined time when said evaporative emission control device is so operated that the fuel vapor stored in the activated charcoal canister is sucked into the engine.

The second aspect of the present invention resides in a method of operating the above-mentioned air-fuel ratio feedback control system. In the method, the air-fuel ratio of air-fuel mixture to be inducted into the engine is detected in accordance with a component of exhaust gas discharged from the engine. An air-fuel ratio feedback correction coefficient is set in accordance with the air-fuel ratio in such a manner as to be modified by a feedback control constant in response to the state of the air-fuel ratio relative to the stoichiometric value. The amount of fuel to be supplied to the engine is corrected with the air-fuel ratio feedback correction coefficient. Additionally, the feedback control constant is enlarged for a predetermined time when the evaporative emission control device is so operated that the fuel vapor stored in the activated charcoal canister is sucked into the engine.

Thus, according to the present invention, even if the air-fuel ratio of the air-fuel mixture to be supplied to the engine temporarily largely fluctuates during suction of the fuel vapor absorbed in the activated charcoal canister, the feedback control constant is enlarged for a predetermined time, thereby improving the follow-up ability of air-fuel ratio feedback control. As a result, the air-fuel ratio can be smoothly controlled to a target air-fuel ratio thereby largely improving exhaust emission control and driveability of the engine. During normal operaion of the engine, the feedback control constant is kept at a smaller value thereby to maintain stable operation of the engine.

DETAILED DESCRIPTION OF THE INVENTION

Figure 1:
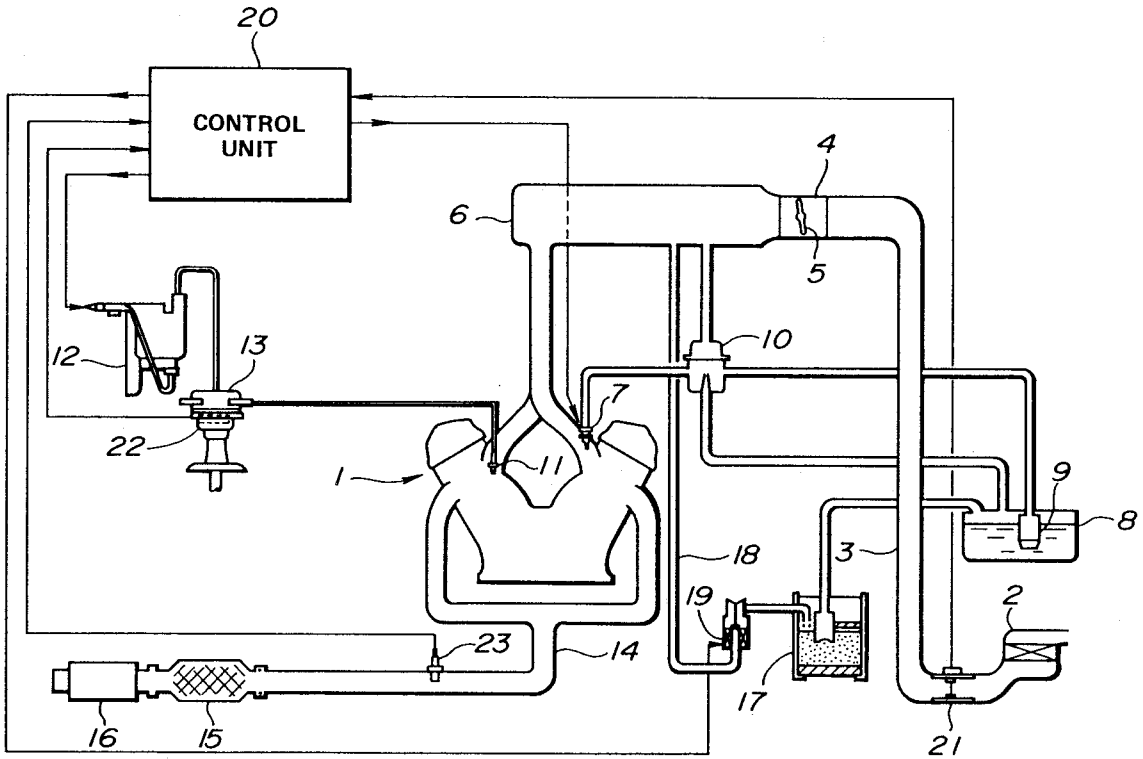
FIG. 1 is a schematic illustration of a preferred embodiment of an air-fuel ratio feedback control system according to the present invention, incorporated with an automotive internal combustion engine.

Referring now to FIG. 1, there is shown a preferred embodiment of an air-fuel ratio feedback control system according to the present invention, incorporated with a V-type multiple cylinder internal combustion engine 1 for an automotive vehicle. During operation of the engine 1, air sucked from an air cleaner 2 is passed through an intake duct 3 and introduced into a throttle chamber 4 to be controlled by a throttle valve 5. Thereafter, air is distributed to the branch runners of an intake manifold 6 to be mixed with fuel (gasoline) injected from a fuel injector valve 7 which is disposed in each intake manifold branch runner to form air-fuel mixture, in which one fuel injector valve 7 is for each engine cylinder (not shown). The thus formed air-fuel mixture is sucked into a combustion chamber (not shown) of each engine cylinder.

The fuel injector valve 7 is of the electromagnetically operated type and such arranged as to open upon supply of electric current to its solenoid while to close upon interruption of electric current supply to the solenoid. Such electric current supply for opening the valve 7 is made in response to drive pulse signal from a control unit 20 which will be discussed after. The fuel injector valve 7 injects fuel when it opens. Fuel to be injected from the fuel injector valve 7 is fed under pressure from a fuel tank 8 through a pressure regulator 10 by which fuel pressure is regulated at a predetermined pressure.

A spark plug 11 is disposed in the combustion chamber of each engine cylinder of the engine 1. A high voltage generated in an ignition coil 12 in accordance with ignition signal from the control unit 20. The thus generated high voltage is impressed through a distributor 13 to the spark plug 11, so that the spark plug 11 produces spark thereby to combust air-fuel mixure fed to the combustion chamber. Exhaust gas from the respective engine cylinders are gathered in an exhaust manifold 14 and discharged to ambient air through a catalytic converter 15 and a muffler 16.

An activated charcoal canister 17 forming part of an evaporative emission control device is so provided that activated charcoal therein absorbs fuel vapor evaporated from the fuel tank 8 and introduced thereto during engine stop or the like. A purge air passage 18 is provided to connect the activated charbon canister 17 and the intake manifold 6 through an electromagnetically operated purge control valve 19. Accordingly, when the purge control valve 19 is opened in response to signal from the control unit 20 under predetermined engine operating conditions except for at least idling condition, fresh air is introduced or sucked from an air filter (no numeral) at the bottom section of the activated charcoal canister 17, so that hydrocarbons (HC) absorbed in the activated charcoal are purged with the thus introduced fresh air. The purging air containing HC is sucked into the intake manifold 6 to be combusted in the combustion chamber in each engine cylinder.

The control unit 20 is constituted of a microcomputer including a CPU, a ROM, a RAM and an input-output device, and adapted to recieve input signals from a variety of sensors and process them thereby to control operation of the fuel injector valve 7, the ignition coil 12 and the purge control valve 19. One of the sensors is a hot-wire type air flow meter 21 which is disposed in the intake air duct 3 and adapted to output signal in accordance with intake air amount Q (the amount of intake air flowing through the intake air duct 3). A crankangle sensor 22 as one of the sensors is disposed in the distributor 13 and adapted to output position signal at invervals of a unit crankangle ( for exmaple, 1 degree) and reference signal at intervals of a standard crankangle (for example, 180 degrees). It will be understood that engine speed N of the enigne 1 can be calculated by measuring the number of the position signals produced per a unit time or the cycle of the reference signal.

Additionally, an oxygen ($O_2$) sensor 23 as one of the sensors is disposed in a gathering section of the exhaust manifold 14 and adapted to output voltage signal in accordance with the ratio between the oxygen concentration in stmospheric air and the oxygen concentration in exhaust gas, in which the electromotive force for the output voltage signal makes its abrupt change at a point at which stoichiometric air-fuel mixture is combusted in the engine cylinders. The oxygen sensor 23 serves as means for detecting air-fuel ratio of air-fuel mixture (i.e., rich or lean relative to stoichiometric air-fuel ratio). In addition, as the above-mentioned sensors, an engine coolant temperature sensor for detecting the temperature of engine coolant, a throttle sensor for detecting the position of the throttle valve 5, or the like may be provided, if necessary.

Figure 2:
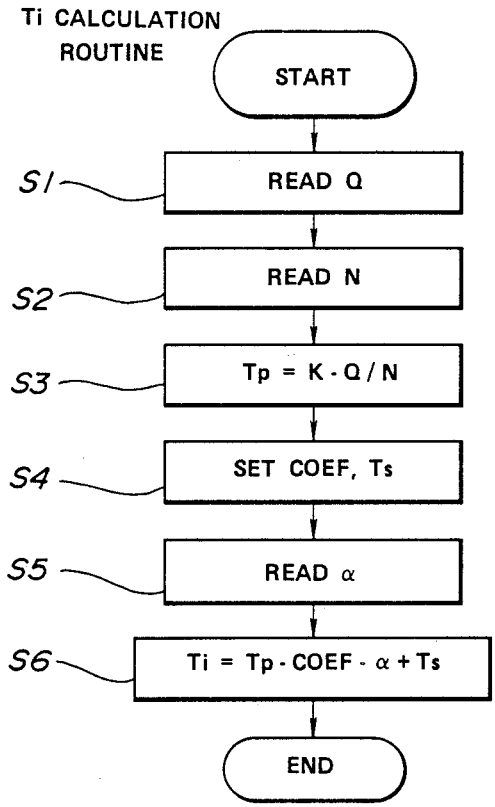
FIG. 2 is a flowchart of a Ti calculation routine as a part of operation of the air-fuel ratio feedback control system of FIG. 1.
Figure 3:
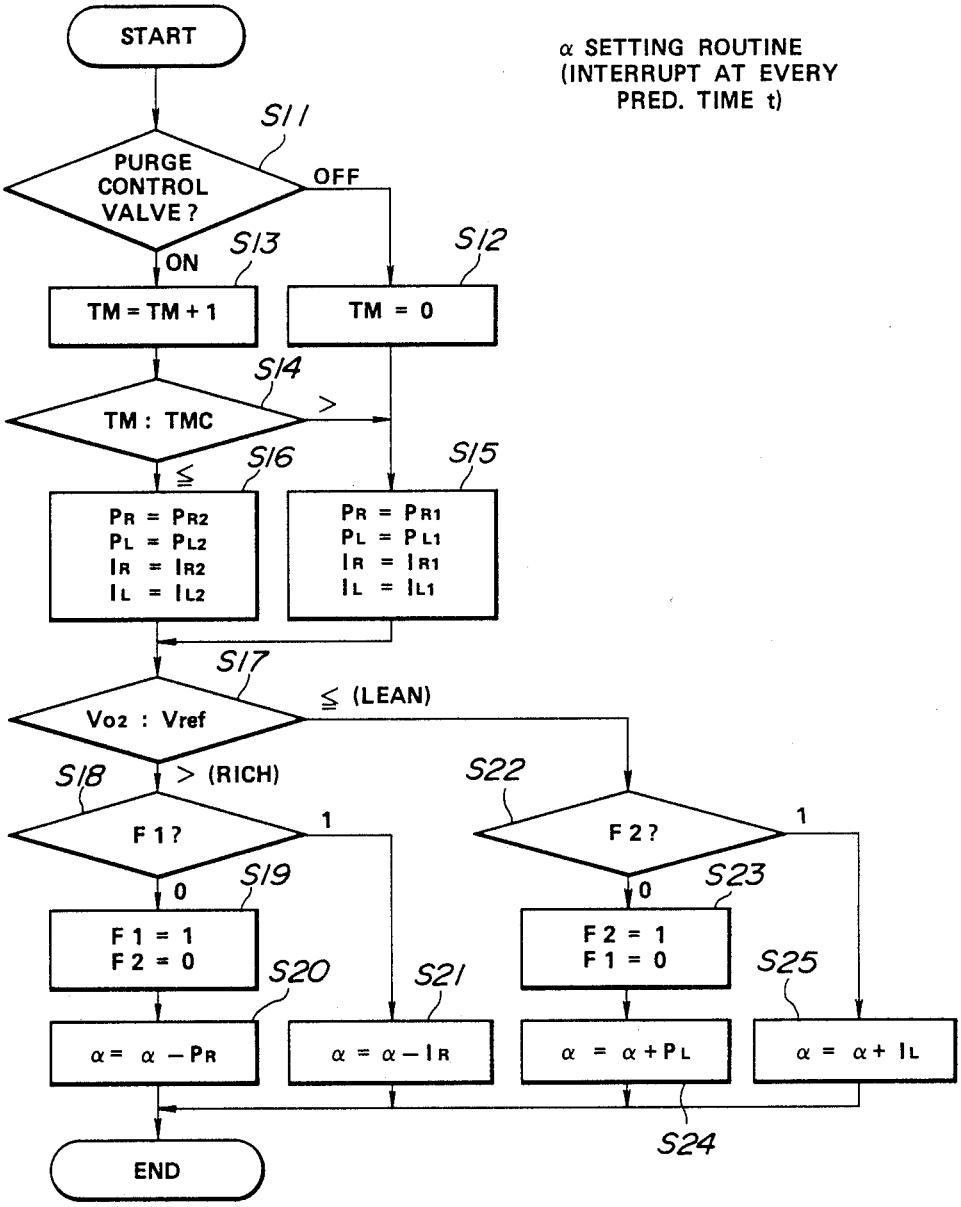
FIG. 3 is a flowchart of a $\alpha$ setting routine as a part of operation of the air-fuel ratio feedback control system of FIG. 1.

Here, the CPU of the microcomputer in the control unit 20 is adapted to calculate and process the data fed thereto according to the programs (a Ti calculation routine and a $\alpha$ setting routine) in the ROM as shown in the flowcharts in FIGS. 2 and 3 and to output the drive pulse signal having a suitable pulse width thereby controlling the fuel injection amount of the fuel injector valve 11.

The manner of operation of the air-fuel ratio feedback control system of this embodiment will be discussed hereinafter with reference to the flowcharts of FIGS. 2 and 3.

In the Ti calculation routine in FIG. 2, at a step S1, the intake air amount Q detected in accordance with the signal from the air flow meter 21 is read. At a step S2, the enigne speed N calculated in accordance with the singal from the crankangle sensor 22 is read. At step S3, a fundamental fuel injection amount Tp is calculated in accordance with the intake air amount Q and the engine speed N, according to the following equation:

$$Tp=K\cdot Q/N$$

where K is a constant.

Next, at a step S4, various correction coefficients COEF are set in accordance with enigne coolant tmeperature (the temperature of the engine coolant), acceleration state of the engine and the like. Additionally, a voltage correction amount Ts is set in accordance with the voltage value of a battery (not shown) as an electric source for the control unit 20. At a step S5, reading is made for present air-fuel ratio feedback correction coefficient $\alpha$ which is set in the $\alpha$ setting routine (discussed after) in FIG. 3. The air-fuel ratio feedback correction coefficient $\alpha$ is set under a proportional-plus-integral control (PI control). In this PI control, the output voltage of the oxygen sensor 23 is compared with a slice level voltage corresponding to stoichiometric air-fuel ratio. In case in which the output voltage of the oxygen sensor is higher or lower than the slice level, the air-fuel ratio is prevented from being suddenly made richer or leaner. That is to say, when the air-fuel ratio is rich (or lean) relative to the stoichiometric air-fuel ratio, the air-fuel ratio feedback correction coefficient $\alpha$ is first reduced (or increased) by the amount of proportion constants $P_R$, $P_L$ discussed after, and then gradually reduced (increased) by the amount of integration constants $I_R$. $I_L$ discussed after, thereby approaching the air-fuel ratio to the stoichiometric value. The proportion and integration constants serve as the feedback control constants.

At a step S6, the fuel injection amount Ti is calculated according to the following equation:

$$Ti=Tp\cdot COEF\cdot\alpha+Ts$$

When the fuel injection amount ti is calculated, the drive pulse signal having the pulse width corresponding to Ti is output at a timing in timed relation to engine revolution to the fuel injector valve 7, thereby accomplishing fuel injection.

Subsequently, the $\alpha$ setting routine will be discussed. This routine is executed at intervals of a predetermined time t by timer interrupt.

At a step S11, judgment is made as to whether the purge control valve 19 is in ON (opening) state or OFF (closing) state. The ON and OFF states are controlled by the same CPU and can be detected without a special sensor. In case in which the purge control valve 19 is in the OFF (closing) state, the routine goes from the step S11 to a step S12 in which a timer value TM (a time measured by a timer which is not shown) is set 0. Thereafter, the routine goes to a step S15 in which proportion constants $P_R$, $P_L$ as feedback control constants are set respectively at relatively small usual values $P_{R1}$, $P_{L1}$, and integration constants $I_R$, $I_L$ as feedback control constants are set respectively at relatively small usual values $I_{R1}$, $I_{L1}$.

In case in which the purge control valve 19 is in the ON (opening) state, the routine goes from the step S11 to a step S13 in which the timer value TM is counted up. Thereafter, the routine goes to a step S14 in which judgment is made as to whetehr the timer value TM is not larger than a predetermined value TMC or not. When the timer value TM is not larger than the predetermined value TMC, a time lapse is within a predetermined time from a time of initiation of sucking the fuel vapor (absorbed in the activated charcoal) to the engine cylinders, and therefore the routine goes from the step S14 to a step S16 in which the proportion constants $P_R$, $P_L$ as the feedback control constants are set respectively at relatively large values $P_{R2}$ ($>P_{R1}$), $P_{L2}$ ($>P_{L1}$), and the integration constants $I_R$, $I_L$ as the feedback control constants are set respectively at relatively large values $I_{R2}$ ($>I_{R1}$), $I_{L2}$ ($>I_{L1}$).

When the timer value TM exceeds the predetermined value TMC, a time lapse exceeds the predetermined time from the time of initiation of sucking the fuel vapor (absorbed in the activated charcoal) to the engine cylinders so that control has reached a normal condition. Consequently, the routine goes from the step S14 to a step S15 in which the proportion constants $P_R$, $P_L$ as the feedback control constants are restored respectively at the previous small values $P_{R1}$, $P_{L1}$, and the integration constants $I_R$, $I_L$ as the feedback control constants are restored to the previous small values $I_{R1}$, $I_{L1}$.

Next at a step S17, judgment is made as to whether the air-fuel ratio of the air-fuel mixture is rich or lean ( relaltive to stoichiometric air-fuel ratio) by comparing output voltage $V_{02}$ from the oxygen sensor 23 with slice level voltage $V_{ref}$ corresponding to the stoichiometric air-fuel ratio. When the air-fuel ratio is rich ($V_{02}>V_{ref}$). the routine goes to a step S18 to judge the value of a flag F1. If a flag F1 is 0, the present time is immediately after the air-fuel ratio is changed from a lean state to a rich state, and therefore routine goes to a step S19 in which the flag Fl is set at 1 while a flag F2 is set at 0. Thereafter, the routine goes to a step S20 in which the air-fuel ratio feedback correction coefficient $\alpha$ is reduced by the predetermined proportion constant $P_R$ relative to a value ($\alpha$) at a prior time. When the flag F1 is judged to be 1 in the step S18, the routine goes to a step S21 in which the air-fuel ratio feedback correction coefficient $\alpha$ is reduced by the predetermined integration constant $I_R$ relaitve to the value ($\alpha$) at the prior time.

When the air-fuel ratio of the air-fuel mixture is lean ($V_{02}\leqq V_{ref}$), the routine goes to a step S22 to judge the value of the flag F2. When the flag F2 is 0, the present time is immediately after the air-fuel ratio is changed from the rich state to the lean state, and therefore the routine goes to a step S23 in which the flag F2 is set at 1 while the flag F1 is set at 0. Thereafter, the routine goes to a step S24 in which the air-fuel ratio feedback correction coefficient $\alpha$ is increased by the predetermined proportion constant $P_L$ relative to the value ($\alpha$) at the prior time. When the flag F2 is judged to be 1 at the step S22, the routine goes to a step 25 in which the air-fuel ratio correction coefficient $\alpha$ is increased by the predetermined integration constant $I_L$ relative to the value ($\alpha$) at the prior time.

As discussed above, according to this embodiment, in the proportional-plus-integral control of the air-fuel ratio feedback correction coefficient $\alpha$, during the predetermined time after initiation of sucking the fuel vapor (absorbed in the activated charcoal canister) to the engine cylinders upon the 0N (opening) state of the purge control valve 19, the proportion constant $P_R$, $P_L$ and the integration constants $I_R$, $I_L$ are increased, thereby improving follow-up characteristics of air-fuel ratio feedback control, thereby effectively and smoothly removing temporary air-fuel ratio fluctuation.

What is claimed is:

1. An air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition, said air-fuel ratio feedback control system comprising:

means for detecting air-fuel ratio of air-fuel mixture to be inducted into the engine in accordance with a component of the exhaust gas discharged from the engine;

means for setting an air-fuel ratio feedback correction coefficient in accordance with said air-fuel ratio, said air-fuel ratio feedback correction coefficient setting means including means for modifying the air-fuel ratio feedback correction coefficient by a feedback control constant in response to a state of said air-fuel ratio relative to stoichiometric value;

means for supplying fuel to the engine;

means for correcting an amount of the fuel supplied from said fuel supplying means with said air-fuel ratio feedback correction coefficient; and means for enlarging said feedback control constant for a predetermined time to alter a damping ratio of said feedback control system when said evaporative emission control device is so operated that the fuel vapor stored in said activated charcoal canister is sucked into the engine.

2. An air-fuel feedback control system as claimed in claim 1, wherein said modifying means includes means for reducing said air-fuel ratio feedback correction coefficient by said feedback control constant when said air-fuel ratio is rich relative to said stoichiometric value, and increasing said air-fuel ratio feedback correction coefficient by said feedback control constant when said air-fuel ratio is lean relative to said stoichiometric value.

3. An air-fuel ratio feedback control system as claimed in claim 1, wherein feedback control constant enlarging means includes means for measuring a predetermined time lapse from initiation of sucking of the fuel vapor into the engine.

4. An air-fuel ratio feedback control system as claimed in claim 3, wherein said feedback control constant enlarging means is operated within said time lapse.

5. An air-fuel ratio feedback control system as claimed in claim 3, further comprising means for minimizing said enlarged feedback control constant after said predetermined time lapse.

6. An air-fuel ratio feedback control system as claimed in claim 3, wherein said feedback control constant includes a first value, and a second value smaller than said first value.

7. An air-fuel ratio feedback control system as claimed in claim 6, wherein said feedback control constant enlarging means includes means for setting said feedback control constant at said first value within said predetermined time lapse.

8. An air-fuel ratio feedback control system as claimed in claim 6, wherein said feedback control constant minimizing means includes means for setting said feedback control constant at said second value after said predetermined time lapse.

9. A method of operating an air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition, said air-fuel ratio feedback control system comprising:

detecting air-fuel ratio of air-fuel mixture to be inducted into the engine in accordance with a component of the exhaust gas discharged from the engine;

setting an air-fuel ratio feedback correction coefficient in accordance with said air-fuel ration, said air-fuel ratio feedback correction coefficient setting step including modifying the air-fuel ratio feedback correction coefficient by a feedback control constant in response to state of said air-fuel ratio relative to stoichiometric value;

supplying fuel to the engine;

correcting an amount of the fuel supplied in said fuel supplying step with said air-fuel ratio feedback correction coefficient; and enlarging said feedback control constant for a predetermined time to alter a damping ratio of said feedback control system when said evaporative emission control device is so operated that the fuel vapor stored in said activated charcoal canister is sucked into the engine.

10. A method as claimed in claim 9, wherein said modifying step includes reducing said air-fuel ratio feedback correction coefficient by said feedback control constant when said air-fuel ratio is rich relative to said stoichiometric value, and increasing said air-fuel ratio correction coefficient by said feedback control constant when said air-fuel ratio is lean relative to said stoichiometric value.

11. A method as claimed in claim 9, wherein feedback control constant enlarging step includes measuring a predetermined time lapse from initiation of sucking of the fuel vapor into the engine.

12. A method as claimed in claim 11, wherein said feedback control constant enlarging step is carried out within said time lapse.

13. A method as claimed in claim 11, further comprising minimizing said enlarged feedback control constant after said predetermined time lapse.

14. A method as claimed in claim 11, wherein said feedback control constant includes a first value, and a second value smaller than said first value.

15. A method as claimed in claim 14, wherein said feedback control constant enlarging step includes setting said feedback control constant at said first value within said predetermined time lapse.

16. A method as claimed in claim 14, wherein said feedback control constant minimizing step includes setting said feedback control constant as said second value after said predetermined time lapse.

17. An air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition, said air-fuel ratio feedback control system comprising:

means for supplying fuel to the engine;

means for correcting amount of the fuel supplied from said fuel supplying means with an air-fuel ratio feedback correction coefficient;

means for detecting air-fuel ratio of air-fuel mixture to be inducted into the engine in accordance with a component of exhaust gas discharged from the engine;

means for setting said air-fuel ratio feedback correction coefficient in accordance with said air-fuel ratio under a proportional-plus-integral control, said air-fuel ratio feedback correction coefficient setting means including means for modifying the air-fuel ratio feedback correction coefficient by an amount corresponding to a proportional constant and an integration constant, in response to state of said air-fuel ratio relative to stoichiometric value; and means for enlarging said proportional and integration constants for a predetermined time to alter a damping ratio of said feedback control system when said evaporative emission control device is so operated that the fuel vapor stored in said activated charcoal canister is sucked into the engine.

18. An air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition, said air-fuel ratio feedback control system comprising:

means for detecting air-fuel ratio of air-fuel mixture to be inducted into the engine in accordance with a component of exhaust gas discharged from the engine;

means for setting an air-fuel ratio feedback correction coefficient in accordance with said air-fuel ratio, said air-fuel ratio feedback correction coefficient setting means including means for modifying the air-fuel ratio feedback correction coefficient by an amount corresponding to a feedback control constant in response to state of said air-fuel ratio relative to stoichiometric value;

means for supplying fuel to the engine;

means for correcting amount of the fuel supplied from said fuel supplying means with said air-fuel ratio feedback correction coefficient;

means for enlarging said feedback control constant for a predetermined time to alter a damping ratio of said feedback control system when said evaporative emission control device is so operated that the fuel vapor stored in said activated charcoal canister is sucked into the engine, said feedback control constant enlarging means including means for measuring a predetermined time lapse for initiation of sucking of the fuel vapor into the engine; and means for minimizing said enlarged feedback control constant after said predetermined time lapse.

19. An air-fuel ratio feedback control system for an internal combustion engine equipped with an evaporative emission control device including an activated charcoal canister in which fuel vapor evaporated from a fuel tank is stored, the stored fuel vapor being sucked into the engine under a predetermined engine operating condition, said air-fuel ratio feedback control system comprising:

means for calculating amount (Ti) of fuel to be supplied to the engine, according to the following equation:

$$Ti = Tp \cdot COEF \cdot \alpha + Ts$$

where Tp is fundamental pulse width corresponding to fundamental fuel supply amount to the engine; COEF is correction coefficient; and $\alpha$ is an air-fuel ratio feedback correction coefficient; and Ts is a voltage correction amount;

means for detecting air-fuel ratio of air-fuel mixture to be inducted into the engine in accordance with a component of exhaust gas discharged from the engine;

means for setting said air-fuel ratio feedback correction coefficient in accordance with said air-fuel ratio, said air-fuel ratio feedback correction coefficient setting means including means for modifying the air-fuel ratio feedback correction coefficient by an amount corresponding to a feedback control constant in response to state of said air-fuel ratio relative to stoichiometric value; and means for enlarging said feedback control constant for a predetermined time to alter a damping ratio of said feedback control system when said evaporative emission control device is so operated that the fuel vapor stored in said activated charcoal canister is sucked into the engine.

* * * * *